US010139061B2

(12) United States Patent
Hollander et al.

(10) Patent No.: US 10,139,061 B2
(45) Date of Patent: Nov. 27, 2018

(54) ADJUSTABLE LIGHTING FIXTURE

(71) Applicant: Hubbell Incorporated, Shelton, CT (US)

(72) Inventors: John Hollander, East Dundee, IL (US); Raymond A. Brown, Greer, SC (US); Steven Holscher, Simpsonville, SC (US); Deepak Sud, Newark, CA (US); Eric Miller, Simpsonville, SC (US); Taylor Aaron Jenson, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/492,655

(22) Filed: Apr. 20, 2017

(65) Prior Publication Data

US 2017/0307153 A1 Oct. 26, 2017

Related U.S. Application Data

(60) Provisional application No. 62/461,504, filed on Feb. 21, 2017, provisional application No. 62/325,102, filed on Apr. 20, 2016.

(51) Int. Cl.

| | |
|---|---|
| ***F21S 8/00*** | (2006.01) |
| ***F21V 15/04*** | (2006.01) |
| *F21Y 115/10* | (2016.01) |
| *F21W 131/208* | (2006.01) |

(52) U.S. Cl.

CPC ..... *F21S 8/036* (2013.01); *F21V 15/04* (2013.01); *F21W 2131/208* (2013.01); *F21Y 2115/10* (2016.08)

(58) Field of Classification Search

CPC .... F21S 8/036; F21Y 2103/10; F21Y 2115/10

USPC ..... 362/217.12, 217.16, 269, 368, 370, 372, 362/418, 430, 432

See application file for complete search history.

(56) References Cited

U.S. PATENT DOCUMENTS

| | | | | |
|---|---|---|---|---|
| 4,368,506 A * | 1/1983 | Rapp | F21V 21/03 | 362/147 |
| 4,449,168 A * | 5/1984 | Ewing | F21V 21/02 | 362/147 |
| 6,467,928 B2 * | 10/2002 | Crelin | F21S 8/033 | 362/147 |
| 6,527,565 B1 * | 3/2003 | Johns | H01R 25/14 | 362/418 |
| 7,029,143 B2 * | 4/2006 | Kiechle | F21S 8/033 | 362/147 |

(Continued)

*Primary Examiner* — Laura Tso

(74) *Attorney, Agent, or Firm* — Dority & Manning, P.A.

(57) ABSTRACT

Lighting fixtures having adjustable components configured to accommodate the application of force (e.g., from a moving patient bed) are provided. In one example embodiment, a lighting fixture can include a housing configured to house a light source. The lighting fixture can include a mounting bracket configured to attach with the housing to secure the housing to a surface. The mounting bracket can include a guide mechanism. The guide mechanism can define a guide channel. The housing is attachable to the mounting bracket such that at least a portion of the housing can move relative to the mounting bracket along the guide channel of the guide mechanism when a force is applied to the housing.

17 Claims, 9 Drawing Sheets

(56) References Cited

U.S. PATENT DOCUMENTS

| | | | | |
|---|---|---|---|---|
| 7,360,929 | B2 * | 4/2008 | Pfund | F21S 8/033<br>248/51 |
| 2003/0227772 | A1 * | 12/2003 | Yoshida | F21V 21/30<br>362/147 |
| 2007/0109798 | A1 * | 5/2007 | Pfund | F21S 8/00<br>362/418 |
| 2010/0254146 | A1 * | 10/2010 | McCanless | F21V 15/01<br>362/368 |

* cited by examiner

ADJUSTABLE LIGHTING FIXTURE

PRIORITY CLAIM

The present application claims the benefit of priority of U.S. Provisional Application Ser. No. 62/461,504, titled "Adjustable Lighting Fixture," filed on Feb. 21, 2017, which is incorporated herein by reference. The present application claims the benefit of priority of U.S. Application Ser. No. 62/325,102, titled "Adjustable Lighting Fixture," filed on Apr. 20, 2016, which is incorporated herein by reference.

FIELD

The present disclosure relates generally to lighting systems.

BACKGROUND

Lighting fixtures are installed onto walls to provide for overall illumination of all or a portion of an adjacent room and/or to provide focused lighting to certain areas of the room. For example, in healthcare applications, a patient or bed lighting fixture can be mounted to the wall above patient beds to provide a focused source of light for ambient or to provide a reading light for the patient.

In healthcare environments, patient beds are often adjustable for patient health and to aid recovery. However, certain adjustments of a patient bed can cause the bed and/or equipment associated therewith to contact other items within the patient's room. For example, the patient bed may be adjusted in such a manner that it contacts a fixture mounted to the wall above the bed. Such contact can damage the lighting fixture, as well as potentially harm an occupant of the room.

SUMMARY

Aspects and advantages of embodiments of the present disclosure will be set forth in part in the following description, or may be learned from the description, or may be learned through practice of the embodiments.

One example aspect of the present disclosure is directed to a lighting fixture. The lighting fixture can include a housing configured to house a light source. The lighting fixture can include a mounting bracket configured to attach with the housing to secure the housing to a surface. The mounting bracket can include a guide mechanism. The guide mechanism can define a guide channel. The housing is attachable to the mounting bracket such that at least a portion of the housing can move relative to the mounting bracket along the guide channel of the guide mechanism when a force is applied to the housing.

Other example aspects of the present disclosure are directed to lighting systems, lighting circuits, lighting fixtures, devices, methods, processes, systems and apparatus according to example aspects of the present disclosure.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
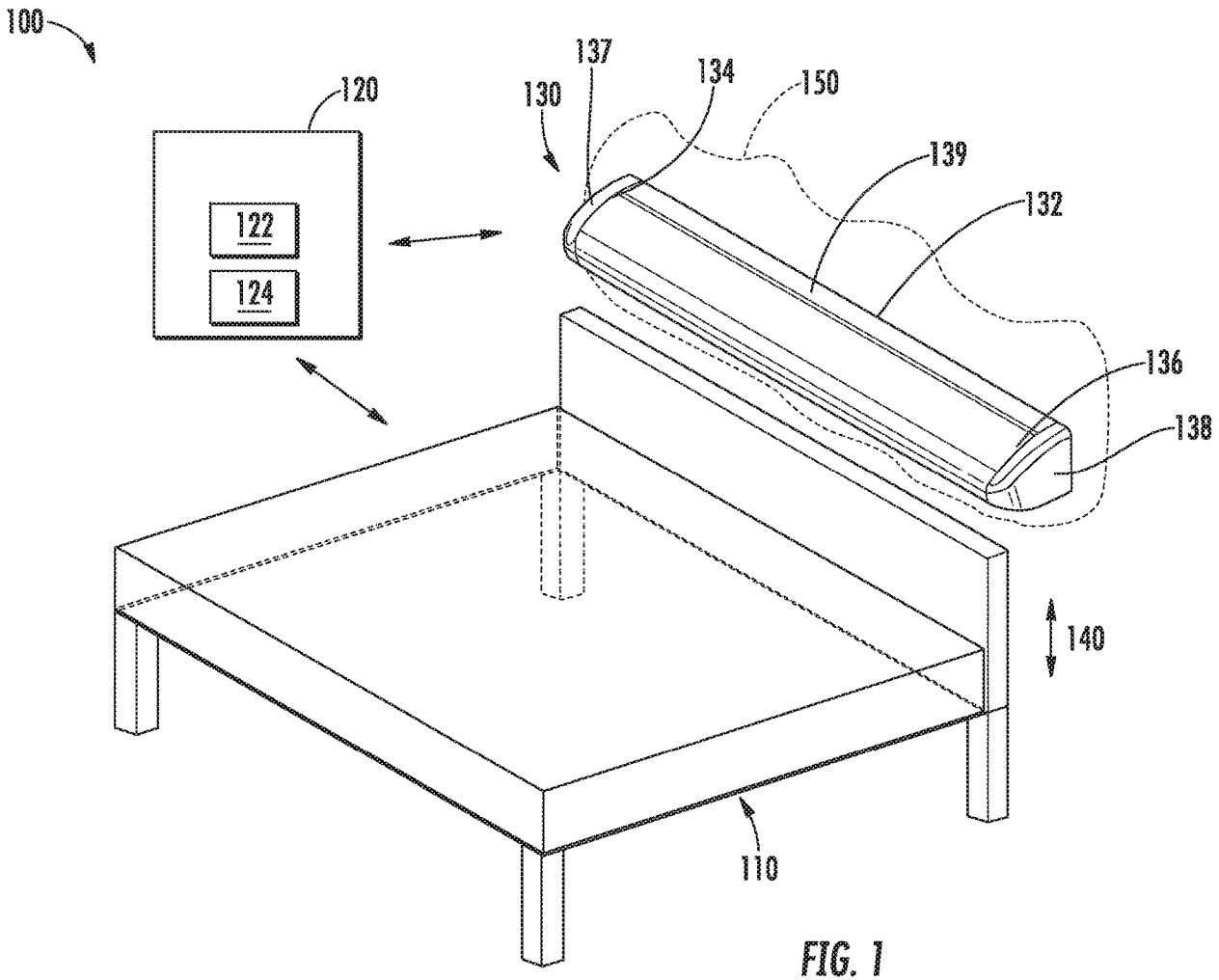
FIG. 1 depicts an example system according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to lighting fixtures having adjustable components to accommodate the application of force, such as a force from a moving patient bed during adjustment of a position of the patient bed. For instance, a lighting fixture can include a mounting bracket and a housing. The mounting bracket can be used to mount the lighting fixture to a wall above a patient bed in a room or space. The housing can contain a plurality of light sources (e.g., LED array(s) or other light sources) for providing illumination within the space.

According to example aspects of the present disclosure, the housing can be attached to the mounting bracket. The mounting bracket can be configured to allow the housing to move a certain distance when force (e.g., an upward vertical force) is applied to the housing. For example, when the patient bed is adjusted in a manner that presses against the housing of the lighting fixture, the mounting bracket can allow the housing to move relative to the mounting bracket. Once the housing has moved a threshold distance, however, a control mechanism (e.g., switch that controls power the patient bed, such as a power outlet or other power source for the bed) can be activated to stop the movement of the patient bed against the housing. In this way, in the event that the patient bed applies a force to the lighting fixture, the housing can move relative to the mounting bracket and, if needed, stop movement of the patient bed, to prevent damage to the lighting fixture.

More particularly, the lighting fixture can include a housing that can contain a plurality of light sources (e.g., LED array) and, in some implementations, can define a plurality of optical compartments. The housing can include one or more end cover(s) and a shroud. The end covers can have a shape or profile that is complementary to the shape or profile of the housing. Moreover, each end cover can include one or more pins.

The lighting fixture can also include means for attaching the lighting fixture to a mounting surface and for allowing the housing to move in one or more direction(s) (e.g., upon an applied force). The means can include a mounting bracket. The mounting bracket can include a back plate and one or more guide mechanism(s). The back plate can be attachable to a mounting surface (e.g., wall). In some implementations, the back plate can be attached to the mounting surface such that the back plate cannot move relative to the mounting surface. The one or more guide mechanism(s) can extend outwardly from the mounting surface (and/or the back plate). Each of the one or more guide mechanism(s) can form, at least a portion of, a guide channel configured to receive one or more pins of the end caps.

In some implementations, the mounting bracket can include a secondary bracket that can be configured to secure the housing to the mounting bracket. The secondary bracket can be adjustable in at least one direction (e.g., a vertical direction) and attachable to the housing such that the housing can move relative to the mounting bracket when a force is applied to the housing while remaining secured to the mounting bracket (and ultimately the mounting surface). By way of example, the secondary bracket can include a moveable mechanism (e.g., cage nut bracket) to which the housing can be attached. The moveable mechanism can be configured to move within the limits defined by the secondary bracket. For instance, the moveable mechanism can move freely within the secondary bracket in the vertical direction within a certain distance range defined by the secondary bracket.

The housing can be attachable to the mounting bracket such that the housing can move relative to the mounting bracket when a force is applied to the housing. For example, the one or more guide mechanism(s) and can be configured to receive the pin(s) of the end covers such that the pins can move within the guide channel(s). Additionally, and/or alternatively, the housing can be attachable to the secondary bracket (e.g., the moveable mechanism). When the housing is attached to the moveable mechanism of the secondary bracket, the housing can move in a manner similar to that of the moveable mechanism and within a similar distance range. In this way, the secondary bracket can define the limits of movement by the housing relative to the mounting bracket. This attachment configuration makes it easier to attach the housing to the mounting bracket and/or can allow the housing greater room to travel in the vertical direction. Moreover, because in some implementations a lower portion of housing is not attached to the mounting bracket, the lower portion of the housing can swing away from the mounting surface if needed to withstand an applied force.

In some embodiments, the lighting fixture can further include a system for controlling and/or terminating the movement of a component that is applying a force to the lighting fixture. For instance, the lighting fixture can include a switch lever arm that is configured to control and/or terminate the movement of the patient bed applying a force to the lighting fixture. The control mechanism can be positioned adjacent to and/or within one or more of the guide channel(s), such that the control mechanism can be activated by movement of the housing. Upon activation, the control mechanism can be configured to terminate the movement of the patient bed, at least in a direction that is applying force to the lighting fixture.

The control mechanism can be configured to alter or stop the movement of the patient bed when the housing has moved a threshold distance. For example, when the lighting fixture is stationary, at least one pin of the housing end covers can rest on the switch lever arm, keeping the switch lever arm in a first position (e.g., such that power can be provided to the patient bed). The patient bed (and/or equipment associated therewith) can apply a force to the lighting fixture. The force can arise from the patient bed and/or other equipment pressing against the lighting fixture when the patient bed is being adjusted. Upon application of the force, the housing can move relative to the mounting bracket, which can remain stationary. Such movement can be facilitated by the pins of the housing end cover(s) moving within the guide channels and/or the moveable mechanism (attached to the housing) moving within the secondary bracket.

When at least one pin moves a threshold distance (e.g., within a guide channel), the pin can cause the switch lever arm to be adjusted from the first position to a second position. In some implementations, the threshold distance can be related and/or similar to the movement range associated with the secondary bracket, as further described herein. When the switch lever arm reaches the second position, the control mechanism can be configured to alter or stop the movement of the patient bed. For example, when in the second position, the control mechanism can be configured to turn off the power to the patient bed such that the mechanism configured to adjust patient bed is unable to further adjust the position/orientation of the patient bed. In this way, the housing can be permitted to withstand a certain amount of force by moving relative to the mounting bracket. However, when the housing has moved a threshold distance the control mechanism can be configured to stop movement of the patient bed to prevent further damage. As such, the control mechanism can provide a safety feature for shutting off the functionality of the patient bed in the event that an object (e.g., the patient bed, equipment) is being pushed against the lighting fixture as the bed position/orientation is being adjusted.

As used herein, a "lighting system" can include, but is not limited to, one or more of a lighting circuit, light engine, one or more lighting fixtures (i.e., luminaires), a plurality of lighting devices arranged in a space, a combination of any of the foregoing, or other system used to provide illumination. A "lighting fixture" or "luminaire" refers to a device used to provide light or illumination using one or more light sources. The use of the term "about" in conjunction with a numerical value is intended to refer to within 20% of the stated numerical value.

FIG. 1 depicts an example system 100 according to example embodiments of the present disclosure. The system 100 can be implemented, for example, in a patient's room in a hospital, clinic, home, etc. As shown, the system 100 can include a patient bed 110, a controller 120, and a lighting fixture 130. The patient bed 110, the controller 120, and/or the lighting fixture 130 can be configured to communicate among one another via one or more wired and/or wireless communication links (e.g., over a network).

The patient bed 110 can be adjustable in various directions and/or positions. For instance, at least a portion of the patient bed 110 can be configured to be adjusted in a vertical direction 140, towards the lighting fixture 130. At least a portion of the patient bed 110 can also, and/or alternatively, be adjusted in a horizontal direction. In some implementations, at least a portion of the patient bed 110 can be configured to move in a clockwise and/or counter-clockwise direction. For example, a portion of the patient bed 110 that is oriented towards a patient's head can be configured to move in the clockwise and/or counter-clockwise direction to recline and/or bring upright a patient's upper body. As the patient bed 110 is adjusted, the patient bed 110 and/or equipment associated therewith (e.g., I.V.) can come into contact with the lighting fixture 130, creating an upward vertical force on the lighting fixture 130.

Controller 120 can include various device(s) configured to control the patient bed 110. For instance, the controller 120 can include one or more control device(s) 122 configured to receive an input (e.g., from a patient) associated with the adjustment of the patient bed 110. The control device(s) 122 can be configured to adjust the position of the patient bed 110 in accordance with the input. Additionally, and/or alternatively, the controller 120 can be associated with a power source 124 (e.g., outlet for connecting electrical power) from which the patient bed 110 and/or its control device(s) 122 receives power.

Lighting fixture 130 can be a multi-function lighting fixture. For instance, as shown in FIG. 1, the lighting fixture 130 can be used as a patient or bed lighting fixture for healthcare applications. The lighting fixture 130 can be mounted to a mounting surface 150 and can be positioned within the vicinity of the patient bed 110 (e.g., above the patient bed 110) to provide various lighting modes within a room. In some implementations, the lighting fixture 130 can provide ambient lighting, serve as an examination light source, serve as a reading light source, etc. Additionally, and/or alternatively, the lighting fixture 130 can serve as a source of low level lighting, which can allow for the fixture to function as a night light and/or a color therapy solution.

The lighting fixture 130 can include a housing 132 and a mounting bracket (not shown in FIG. 1). The housing 132 can extend lengthwise, vertically, and laterally. The housing 132 can contain a plurality of light sources (e.g., LED array(s) or other light sources) and, in some implementations, can define a plurality of optical compartments, with each optical compartment being associated with one of the light sources for directing light outwardly from the housing 132.

The housing 132 can include one or more end cover(s) 137 and 138. For instance, the housing 132 can include a first end cover 137 positioned adjacent to a first end 134 and a second end cover 138 positioned adjacent to a second end 136. In some implementations, the end covers 137 and 138 can have a shape or profile that is complementary to the shape or profile of the housing 132 to provide a continuous or uniform aesthetic look to the lighting fixture 130. As further described herein, each end cover 137 and 138 can be positioned adjacent to and/or engage with the mounting bracket of the lighting fixture 130 (e.g., at the ends 134 and 136) to allow the housing 132 to move relative to the mounting bracket. Additionally, and/or alternatively, the end covers 137 and 138 can be positioned over and/or adjacent to the mounting bracket to conceal any associated mounting hardware and/or wiring of the lighting fixture 100.

The housing 132 can include a shroud 139, which can be configured to secure the housing 132 to the mounting bracket. For instance, as further described herein, the shroud 139 can be attached to the mounting bracket in such a manner to secure the lighting fixture 130 to a mounting surface 150, as well as to allow the housing 132 to move in the event a force is applied to the lighting fixture 130.

Figure 2:
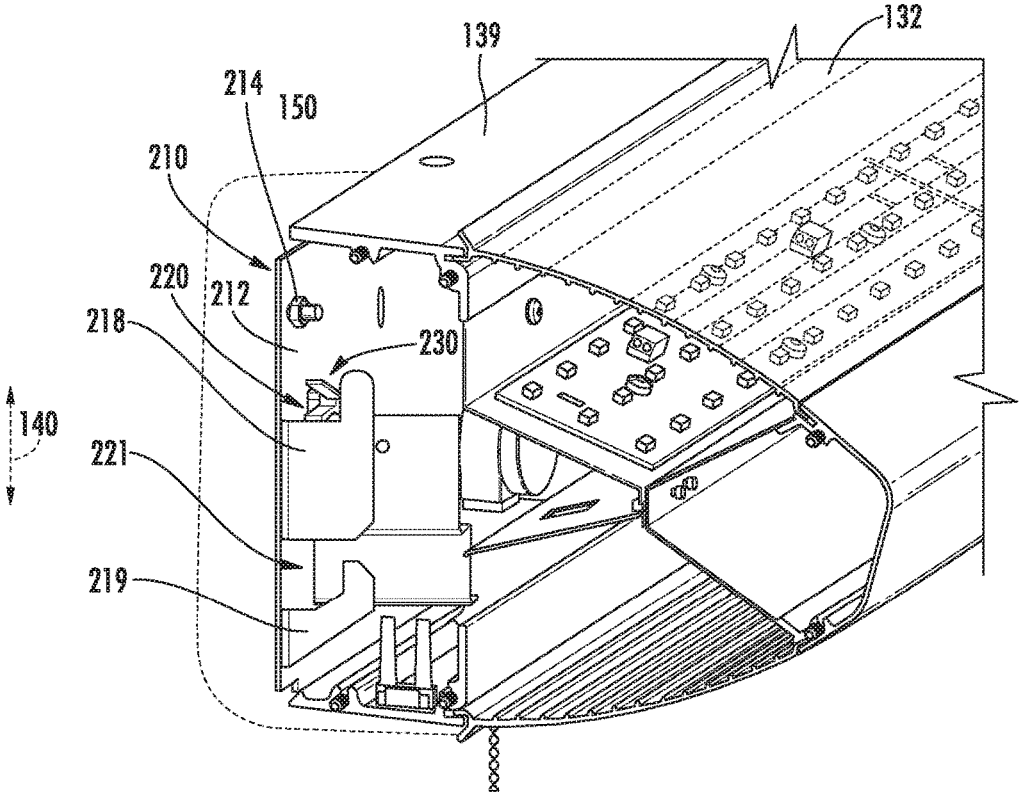
FIG. 2 depicts a perspective, end view of a portion of an example lighting fixture with an end cover removed according to a first example embodiment of the present disclosure.

FIG. 2 depicts a perspective, end view of a portion of the lighting fixture 130 with an end cover (e.g., end cover 137) removed according to an example embodiment of the present disclosure. The lighting fixture 130 can include means for attaching the lighting fixture 130 to the mounting surface 150 and for allowing the housing 132 to move in one or more direction(s) (e.g., upon an applied force). For instance, as shown in FIG. 2, the means can include a mounting bracket 210. The mounting bracket 210 can be made of metal, polymer, and/or any other material that is sufficiently rigid to support the weight of the lighting fixture 130 (and the forces applied thereto) and to perform the functions described herein.

The mounting bracket 210 can include a back plate 212 that can be attachable to the mounting surface 150. The back plate 212 can extend lengthwise, for example, between the first end 134 and the second end 136. The back plate 212 can also extend vertically between the top and bottom sides of the housing 132. The back plate 212 can be attached to the mounting surface 150 via one or more attachment mechanism(s) 214. The attachment mechanism(s) 214 can include screws, rivets, nails, other fasteners, snap connections, male-female connections, sliding connections, adhesives, etc. In some implementations, the back plate 212 can be attached to the mounting surface 150 such that the back plate 212 cannot move relative to the mounting surface 150. As further described herein, the mounting bracket 210 can include means for attaching the shroud 139 to the mounting bracket 210 to facilitate movement of the housing 132 relative to the mounting bracket 210.

The mounting bracket 210 can be configured to extend outwardly from the mounting surface 150 at one or more of the end(s) 134 and 136. For example, the mounting bracket 210 can include one or more guide mechanism(s) 218 and 219. In some implementations, the back plate 212 and the one or more guide mechanism(s) 218 and 219 can be formed as a continuous piece of material. In other implementations, the back plate 212 and the one or more guide mechanism(s) 218 and 219 can be formed as separate pieces of material. In some implementations, one or more of the guide mechanism(s) 218 and 219 can be formed as a G-hook shape.

As shown in FIG. 2, the mounting bracket 210 can include a first guide mechanism 218. The first guide mechanism 218 can be configured to form, at least a portion of, a first guide channel 220. In some implementations, the mounting bracket 210 can include a second guide mechanism 219. The second guide mechanism 219 can be positioned below the first guide mechanism 218, relative to the bottom side of the lighting fixture 130. The second guide mechanism 219 can be configured to form, at least a portion of, a second guide channel 221. In some implementations, the back plate 212 can form, at least a portion of, one or more of the guide channel(s) 220 and 221. As further described herein, the end cover(s) 137 and 138 can be configured to engage the mounting bracket 210 in the guide channel(s) 220 and/or 221 to allow the housing 132 to move relative to the mounting bracket 210.

The lighting fixture 130 can include means for controlling and/or terminating the movement of an object that is applying a force to the lighting fixture 120. For instance, the lighting fixture 130 can include a control mechanism 230 that is configured to alter the movement of an object (e.g., patient bed 110) applying a force to the lighting fixture 130. The control mechanism 230 can be positioned adjacent to and/or within one or more of the guide channel(s) 220 and/or 221, such that the control mechanism 230 can be activated by movement of the housing 132, as further described herein. Upon activation, the control mechanism 230 can be configured to stop the movement of the patient bed 110, at least in a direction that is applying force to the lighting fixture 130. As such, the control mechanism 230 can provide a safety feature for shutting off the functionality of the patient bed 110 in the event that an object (e.g., the patient bed, equipment) is being pushed against the lighting fixture 130 as the bed position/orientation is being adjusted.

Figure 3:
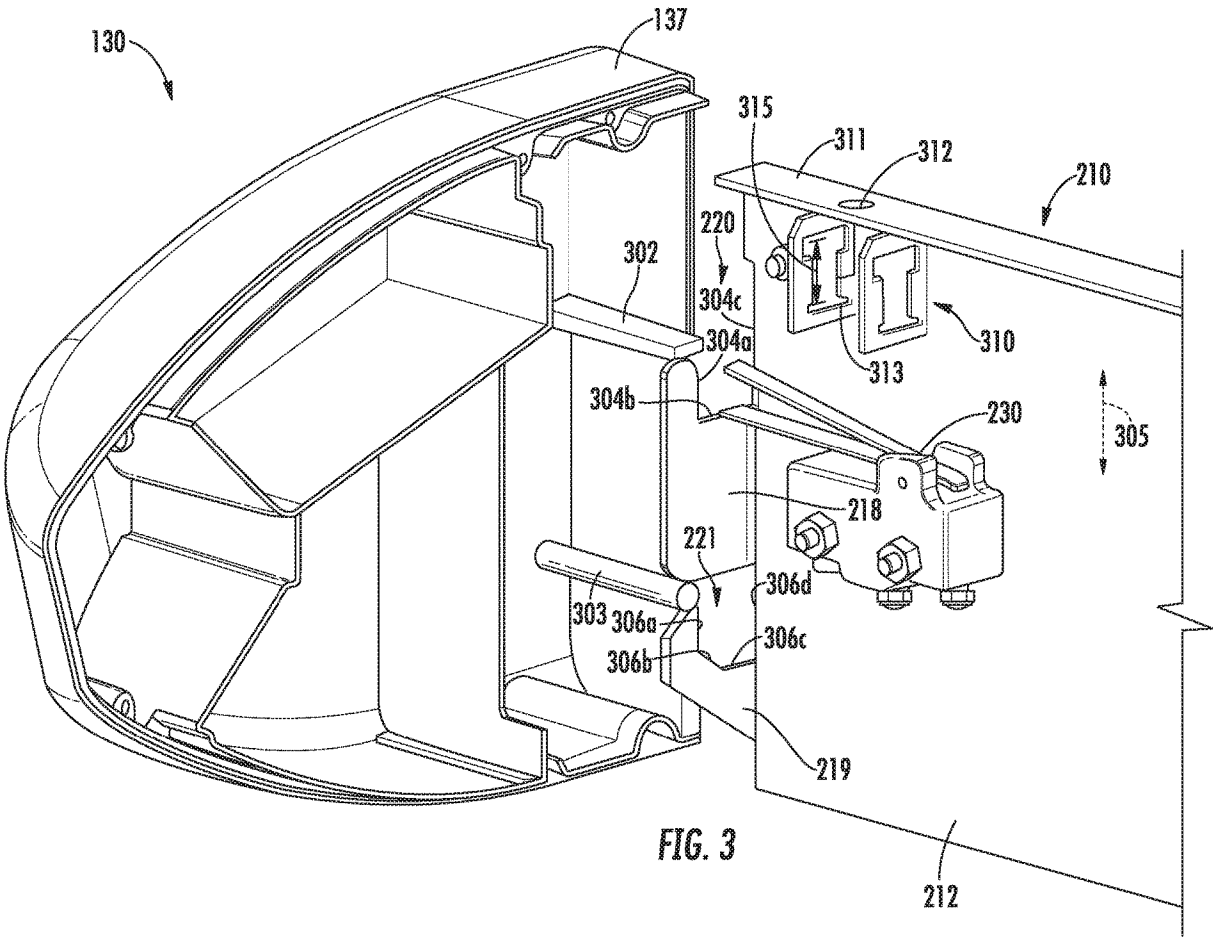
FIG. 3 depicts portions of an example lighting fixture according to the first example embodiment of the present disclosure.
Figure 4:
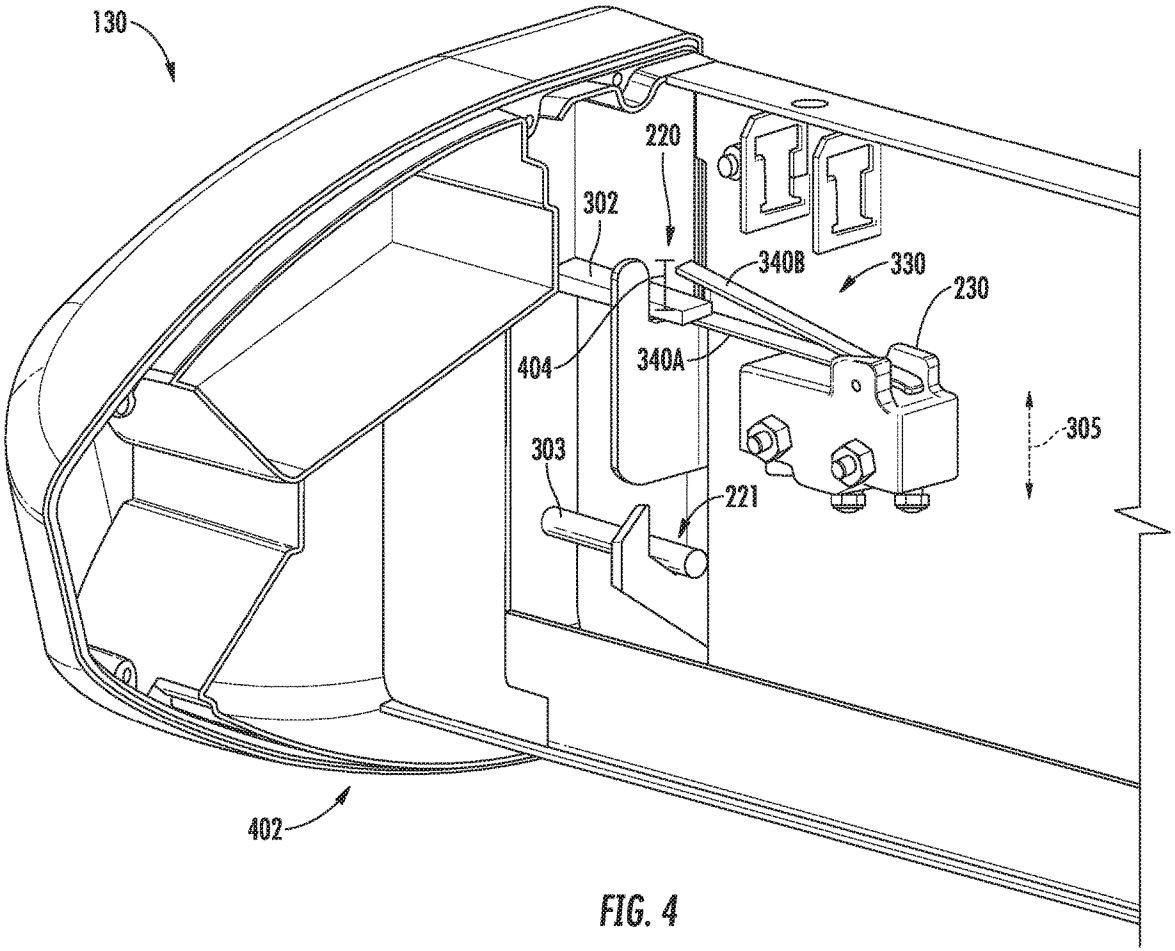
FIG. 4 depicts portions of an example lighting fixture according to the first example embodiment of the present disclosure.
Figure 5:
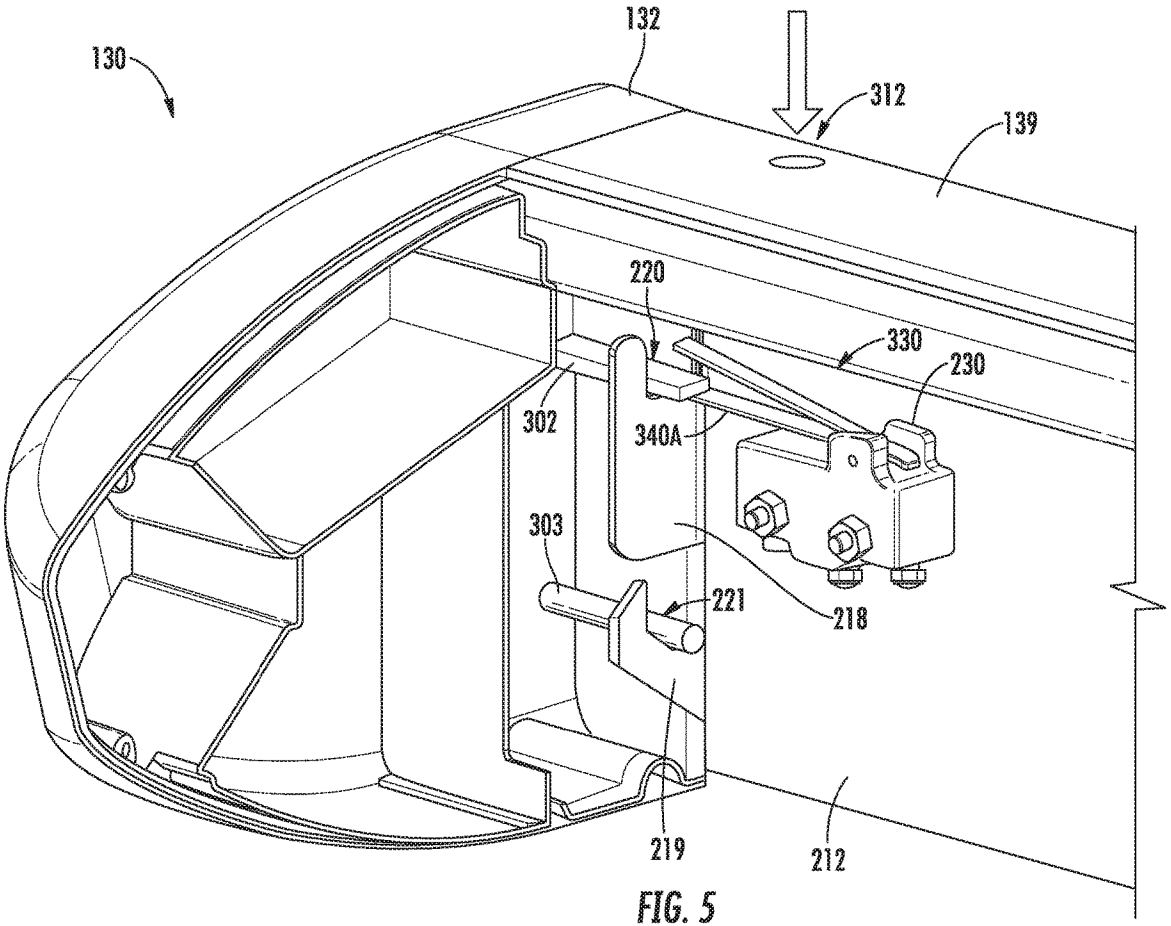
FIG. 5 depicts portions of an example lighting fixture according to the first example embodiment of the present disclosure.

FIGS. 3-5 depict portions of lighting fixture 130 according to example embodiments of the present disclosure. Particularly, FIGS. 3-5 show the mounting bracket 210 and first end cover 137 of the lighting fixture 130 (e.g., at end 134). While FIGS. 3-5 depicts only the first end cover 137 and the mounting bracket 210 at the first end 134, the second end cover 138 and the mounting bracket 210 at the second end 136 can have a substantially similar configuration to that described with respect to FIGS. 3-5. For instance, the mounting bracket 210 can have similar components at both ends 134 and 136 and the second end cover 138 can have similar components to the first end cover 137.

As indicated above, the mounting bracket 210 can include means for attaching the housing 132 to the mounting bracket 210 to facilitate movement of the housing 132 relative to the mounting bracket 210. In some implementations, the means can include the guide channels 220 and 221. As shown in FIG. 3, each of the guide channel(s) 220 and 221 can be formed by a plurality of guide surfaces. The guide surfaces can be a portion of the guide mechanism(s) 218 and 219, a portion of the back plate 212, and/or a portion of another component of the mounting bracket 210. For example, as shown in FIG. 3, a first plurality of guide surfaces 304*a-c* can form the first guide channel 220. A first guide surface 304*a* and a second guide surface 304*b* can be a portion of the first guide mechanism 218. A third guide surface 304*c* can be a portion of the back plate 212. In combination, the first, second, and third guide surfaces 304*a-c* can form the first guide channel 220. A second plurality of guide surfaces 306*a-d* can form the second guide channel 220. A fourth guide surface 306*a*, a fifth guide surface 306*b*, and a sixth guide surface 306*c* can be a portion of the second guide mechanism 219. A seventh guide surface 306*d* can be a portion of the back plate 212. In combination, the fourth, fifth, sixth, and seventh guide surfaces 306*a-d* can form the second guide channel 221. The shape and configuration of the guide channel(s) 220 and 221 can help define the directions in which the housing 132 can move relative to the mounting bracket 210, in the event a force is applied to the lighting fixture 130.

In some implementations, the means for attaching the housing 132 to the mounting bracket 210 to facilitate movement of the housing 132 relative to the mounting bracket 210 can include a secondary bracket 310 which can be attached to the housing 132 and can be configured to secure the housing 132 (e.g., the shroud 139) to the back plate 212. In some implementations, at least a portion of the housing 132 can be positioned adjacent to a flange 311 of the mounting bracket 210. The housing 132 can be attached to a secondary bracket 310 via an attachment mechanism placed in a hole 312 located above the secondary bracket 310.

The secondary bracket 310 can be adjustable in at least one direction and attachable to the housing 132, such that the housing 132 can move in at least the one direction relative to the mounting bracket 210. For instance, the secondary bracket 310 can be configured to allow the housing 132 to move in a vertical direction 305 relative to the mounting bracket 210, while remaining secured to the mounting bracket 210 (and ultimately the mounting surface 150). By way of example, the secondary bracket 310 can include a moveable mechanism 313 (e.g., cage nut bracket) to which the housing 132 can be attached. The moveable mechanism 313 can be configured to move within limits defined by the secondary bracket 310. For example, the moveable mechanism 313 can be configured to move a certain distance range 315, which can be defined by the configuration of the secondary bracket 310. The moveable mechanism 313 can move freely within the secondary bracket 310 at least in one direction (e.g., in the vertical direction 305 in a horizontal direction, other directions) within the distance range 315. Thus, when the housing 132 is attached to the moveable mechanism 313 of the secondary bracket 310, the housing 132 can move in a manner similar to that of the moveable mechanism 313 (e.g., in a vertical direction 305) within a range that is similar to that of the distance range 315. In this way, the secondary bracket 310 can define the limits of movement by the housing 132 relative to the mounting bracket 210. Moreover, this can limit the movement of the housing 132 to prevent a portion of the lighting fixture 130 becoming disengaged from the mounting bracket 210.

The housing 132 can be attachable to the mounting bracket 210 such that the housing 132 can move relative to the mounting bracket 210 when a force is applied to the housing 132. For example, the one or more guide mechanism(s) 218 and 219 can be configured to receive at least a portion of the housing 132 such that the housing 132 is adjustable relative to the mounting bracket 210. As shown in FIG. 4, pin(s) 302 and 303 of the first end cover 137 can be configured to fit and move within the guide channel(s) 220 and 221. For instance, the first pin 302 can fit into the first guide channel 220 and/or the second pin 303 can fit into the second guide channel 221. Additionally, and/or alternatively, the housing 132 can be attachable to the secondary bracket 310 such that the housing 132 can move relative to the mounting bracket 210 in at least one direction. For example, as shown in FIG. 5, the housing 132 (e.g., the shroud 139) can be attached to the secondary bracket 310 via an attachment mechanism (e.g., screw) placed in the hole 312. In this way, the housing 12 can be allowed to move within the distance range 315 defined by the secondary bracket. Moreover, the pin(s) 302 and 303 can be configured to move within the within the guide channel(s) 220 and 221, within a range similar to that of the distance range 315.

Returning to FIG. 4, the lighting fixture 130 can include a control mechanism 230 that is configured to alter and/or stop the movement of the patient bed 110 when the housing 132 has moved a threshold distance. For instance, one or more of the guide channel(s) 220 and 221 can include the control mechanism 230. As shown in FIG. 4, at least a portion of the control mechanism 230 can be positioned within the first guide channel 220. Upon application of a force 402, the first pin 302 can move in a vertical direction 305 within the guide channel 220. When the first pin 302 has moved a threshold distance 404, the control mechanism 230 can be activated. The threshold distance 404 can be defined by, related to, and/or similar to the distance range 315 associated with the secondary bracket 310. For example, the threshold distance 404 can be configured to be equal to and/or less than the upper limit (e.g., furthest point in the vertical direction 305) of the distance range 315. In this way, the control mechanism 230 can alter and/or stop the movement of patient bed 110 before and/or when the housing 132 reaches its movement limitation.

Upon activation, the control mechanism 230 can be configured to send a command signal to the controller 120 to change and/or terminate the movement of the patient bed 110 when the housing 132 has moved a threshold distance, as further described herein. In some implementations, the control mechanism 230 can be connected to the power source 124 (e.g., outlet for connecting electrical power), such that when the control mechanism 230 is activated the power supply for the movement of the patient bed 110 is shut off. By way of example, the control mechanism 230 can include a switch lever arm 330. When the lever arm 330 is in the first position 340A, the switch can be closed and the power to the patient bed 110 can be on. When the lever arm 330 is in the second position 340B, the switch can be open and the power to the patient bed 110 can be off.

In some implementations, the first guide channel 220 can guide the first pin 302 to activate the control mechanism 230. By way of example, when the lighting fixture 130 is stationary, the first pin 302 can rest on the switch lever arm 330, keeping the switch level arm 330 in the first position 340A. The patient bed 110 (and/or equipment associated therewith) can apply a force 402 to the lighting fixture 130. The force 402 can arise from the patient bed 110 and/or other equipment pressing against the lighting fixture 130 when the patient bed 110 is being adjusted. Upon application of the force 402, the housing 132 can move (e.g., in vertical direction 305) relative to the mounting bracket 210, which can remain stationary. Such movement can be facilitated by the pins 302 and 303 of the first end cover 137 moving within the guide channels 220 and 221 and/or the moving mechanism 313 (attached to the housing 132) moving within the secondary bracket 310.

The first pin 302 can move within the first guide channel 220, causing the switch lever arm 330 to be adjusted from the first position 340A to the second position 340B. When the switch lever arm 330 reaches the second position 340B, the control mechanism 230 can be configured to alter the movement of the patient bed 110. For example, when in the second position 340B, the control mechanism 230 can be configured to turn off the power to the patient bed 110 (e.g., by opening a switch associated with the power source 124) such that the mechanism configured to adjust patient bed 110 (e.g., controller 120) is unable to further adjust the position/orientation of the patient bed 110. Additionally, and/or alternatively, the control mechanism 230 can send a command signal to the controller 120 to cease further movement of the patient bed 110 (at least in the direction towards the lighting fixture 130). In this way, the control mechanism 230 can prevent further application of force 402 and/or movement of the housing 132, helping to prevent potential damage to the lighting fixture 130.

Figure 6:
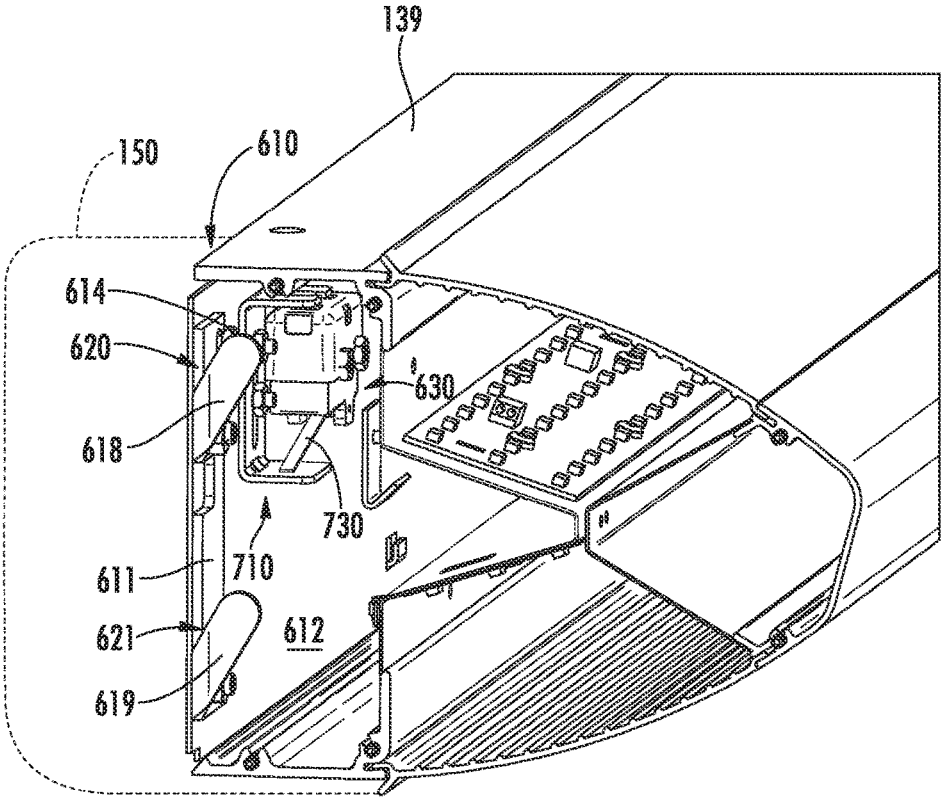
FIG. 6 depicts a perspective, end view of a portion of an example lighting fixture with an end cover removed according to a second example embodiment of the present disclosure.

FIG. 6 depicts a perspective, end view of a portion of lighting fixture 130 with an end cover removed according to another example embodiment of the present disclosure. The lighting fixture 130 can include means for attaching the lighting fixture 130 to the mounting surface 150 and for allowing the housing 132 to move in one or more direction(s) (e.g., upon an applied force). For instance, as shown in FIG. 6, the means can include a mounting bracket 610. The mounting bracket 610 can be made of metal, polymer, and/or any other material that is sufficiently rigid to support the weight of the lighting fixture 130 (and the forces applied thereto) and to perform the functions described herein.

The mounting bracket 610 can include a back plate 612 that can be attachable to the mounting surface 150. The back plate 612 can extend lengthwise, for example, between the first end 134 and the second end 136. The back plate 612 can also extend vertically between the top and bottom sides of the housing 132. The back plate 612 can be attached to the mounting surface 150 via one or more attachment mechanism(s) 614. The attachment mechanism(s) 614 can include screws, rivets, nails, other fasteners, snap connections, male-female connections, sliding connections, adhesives, etc. In some implementations, the back plate 612 can be attached to the mounting surface 150 such that the back plate 612 cannot move relative to the mounting surface 150. As further described herein, the mounting bracket 610 can include means for attaching the shroud 139 to the mounting bracket 610 to facilitate movement of the housing 132 relative to the mounting bracket 610.

The mounting bracket 610 can be configured to extend outwardly from the mounting surface 150 at one or more of the end(s) 134 and 136. For example, the mounting bracket 610 can include one or more guide mechanism(s) 618 and 619. In some implementations, the back plate 612 and the one or more guide mechanism(s) 618 and 619 can be formed as a continuous piece of material. In other implementations, the back plate 612 and the one or more guide mechanism(s) 618 and 619 can be formed as separate pieces of material. In some implementations, one or more of the guide mechanism(s) 618 and 619 can be formed as a continuous piece of metal 611 which is separate from the back plate 612 and mounted to the back plate 612 via the one or more attachment mechanism(s) 614. In some implementations, the same one or more attachment mechanism(s) 614 that are used to mount the back plate 612 to the mounting surface 150 can be used to mount the continuous piece of metal 611 to the back plate 612. In some implementations, a separate set of one or more attachment mechanism(s) 614 can be used to mount the continuous guide mechanism 611 to the back plate 612. In some implementations, the one or more of the guide mechanism(s) 618 and 619 can be formed as a linear or near-linear surface at some non-perpendicular angle from the back plate 612.

As shown in FIG. 6, the mounting bracket 610 can include a first guide mechanism 618. The first guide mechanism 618 can be configured to form, at least a portion of, a first guide channel 620. In some implementations, the mounting bracket 610 can include a second guide mechanism 619. The second guide mechanism 619 can be positioned below the first guide mechanism 618, relative to the bottom side of the lighting fixture 130. The second guide mechanism 619 can be configured to form, at least a portion of, a second guide channel 621. In some implementations, the back plate 612 can form, at least a portion of, one or more of the guide channel(s) 620 and 621. As further described herein, the end cover(s) 137 and 138 can be configured to engage the mounting bracket 610 in the guide channel(s) 620 and/or 621 to allow the housing 132 to move relative to the mounting bracket 610.

The lighting fixture 130 can include means for controlling and/or terminating the movement of an object that is applying a force to the lighting fixture 130. For instance, the lighting fixture 130 can include a control mechanism 630 that is configured to alter the movement of an object (e.g., patient bed 110) applying a force to the lighting fixture 130. The control mechanism 630 can be activated by movement of the housing 132, as further described herein. Upon activation, the control mechanism 630 can be configured to stop the movement of the patient bed 110, at least in a direction that is applying force to the lighting fixture 130. As such, the control mechanism 630 can provide a safety feature for shutting off the functionality of the patient bed 110 in the event that an object (e.g., the patient bed, equipment) is being pushed against the lighting fixture 130 as the bed position/orientation is being adjusted.

Figure 7:
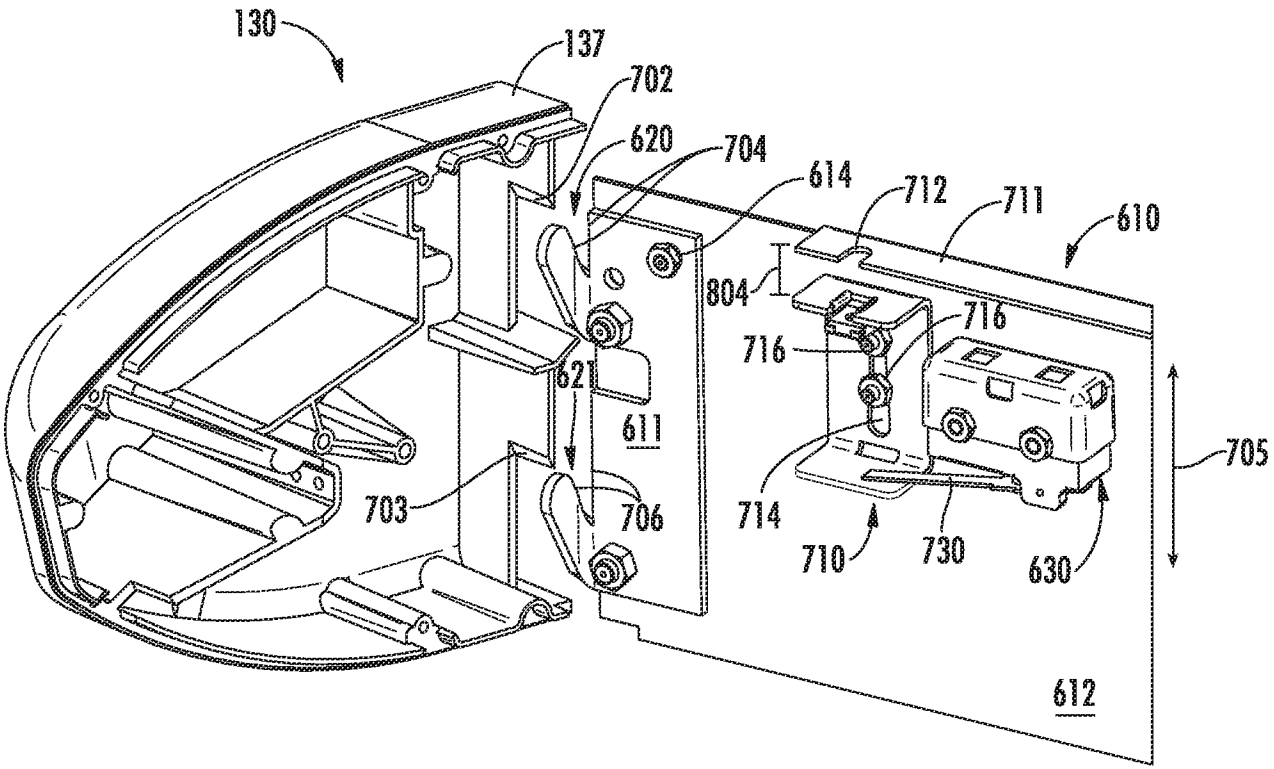
FIG. 7 depicts portions of an example lighting fixture according to the second example embodiment of the present disclosure.
Figure 8:
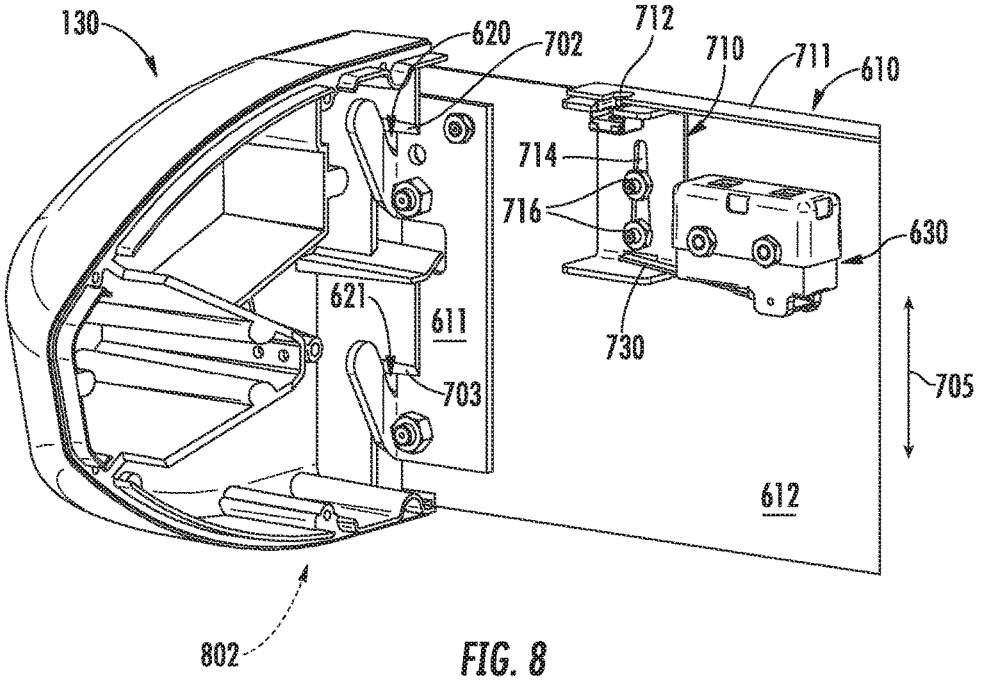
FIG. 8 depicts portions of an example lighting fixture according to the second example embodiment of the present disclosure.
Figure 9:
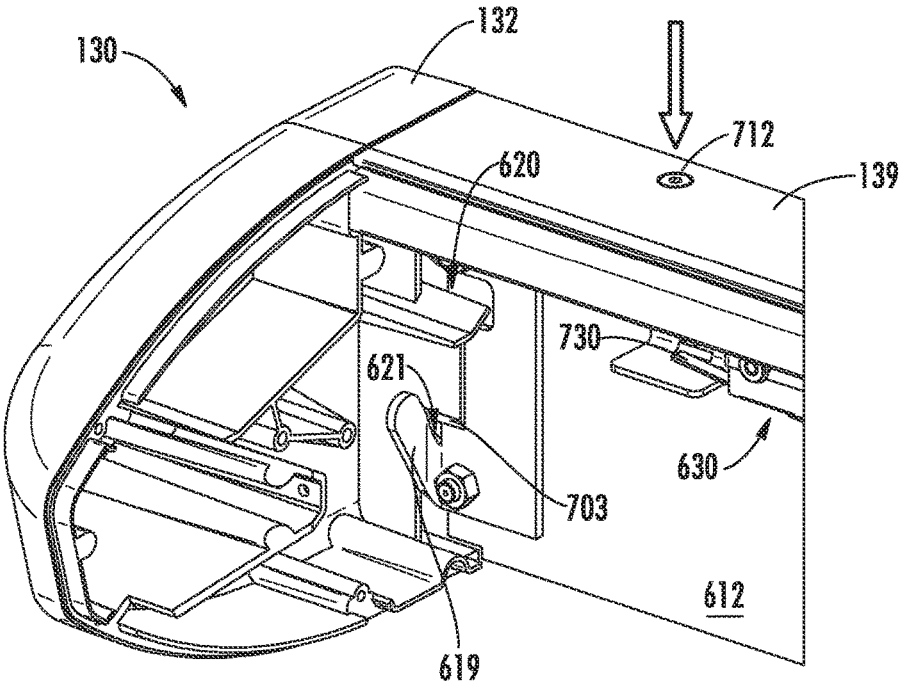
FIG. 9 depicts portions of an example lighting fixture according to the second example embodiment of the present disclosure.

FIGS. 7-9 depict portions of the lighting fixture 130 according to example embodiments of the present disclosure. Particularly, FIGS. 7 through 9 show the mounting bracket 610 and the first end cover 137 of the lighting fixture 130 (e.g., at end 134). While FIGS. 7 through 9 depict only the first end cover 137 and the mounting bracket 610 at the first end 134, the second end cover 138 and the mounting bracket 610 at the second end 136 can have a substantially similar configuration to that described with respect to FIGS. 7 through 9. For instance, the mounting bracket 610 can have similar components at both ends 134 and 136 and the second end cover 138 can have similar components to the first end cover 137.

As indicated above, the mounting bracket 610 can include means for attaching the housing 132 to the mounting bracket 610 to facilitate movement of the housing 132 relative to the mounting bracket 210. In some implementations, the means can include the guide channels 620 and 621. Each of the guide channel(s) 620 and 621 can be formed by a plurality of guide surfaces. The guide surfaces can be a portion of the guide mechanism(s) 618 and 619, a portion of the back plate 612, and/or a portion of another component of the mounting bracket 610. For example, as shown in FIG. 7, one or more first guide surfaces 704 can form the first guide channel 620. A first guide surface 704 can be a portion of the first guide mechanism 618. Another first guide surface 704 can be a portion of the back plate 612. In combination, the first guide surfaces 704 can form the first guide channel 620. A second plurality of guide surfaces 706 can form the second guide channel 621. Another second guide surface 706 can be a portion of the back plate 612. In combination, the second guide surfaces 706 can form the second guide channel 621. The shape and configuration of the guide channel(s) 620 and 621 can help define the directions in which the housing 132 can move relative to the mounting bracket 610, in the event a force is applied to the lighting fixture 130.

In some implementations, the means for attaching the housing 132 to the mounting bracket 610 to facilitate movement of the housing 132 relative to the mounting bracket 610 can include a secondary bracket 710 which can be attached to the housing 132 and can be configured to secure the housing 132 (e.g., the shroud 139) to the back plate 612. In some implementations, at least a portion of the housing 132 can be positioned adjacent to a flange 711 of the mounting bracket 610. The housing 132 can be attached to the secondary bracket 710 via an attachment mechanism placed in a hole 712 located above the secondary bracket 710.

The secondary bracket 710 can be adjustable in at least one direction and attachable to the housing 132, such that the housing 132 can move in at least the one direction relative to the mounting bracket 610. For instance, the secondary bracket 710 can be configured to allow the housing 132 to move in a vertical direction 705 relative to the mounting bracket 610, while remaining secured to the mounting bracket 610 (and ultimately the mounting surface 150). The secondary bracket 710 can define a channel 714 that extends along the vertical direction 705. As shown, the secondary bracket 710 can be attached to the back plate 612 of the mounting bracket 610 via one or more attachment mechanism(s) 716 (e.g., cage nut bracket) that extend through the channel 714 and the back plate 612 of the mounting bracket 610.

It should be appreciated that movement of the secondary bracket 710 can be constrained. In particular, movement along the vertical direction 705 can be limited to a threshold distance 804 that corresponds to an amount of vertical space defined between the secondary bracket 710 and the flange 711. Thus, when the housing 132 is attached to the secondary bracket 710, the housing 132 can move in a manner similar to that of the secondary bracket 710 (e.g., in a vertical direction 705) within a range that is similar to that of the threshold distance 804. In this way, the secondary bracket 710 can define the limits of movement by the housing 132 relative to the mounting bracket 610. Moreover, this can limit the movement of the housing 132 to prevent a portion of the lighting fixture 130 becoming disengaged from the mounting bracket 610.

The housing 132 can be attachable to the mounting bracket 610 such that the housing 132 can move relative to the mounting bracket 610 when a force is applied to the housing 132. For example, the one or more guide mechanism(s) 618 and 619 can be configured to receive at least a portion of the housing 132 such that the housing 132 is adjustable relative to the mounting bracket 210. As shown in FIG. 8, end cover guide surface(s) 702 and 703 of the first end cover 137 can be configured to fit and move within the guide channel(s) 620 and 621. For instance, the first end cover guide surface 702 can fit into the first guide channel 620 and/or the second end cover guide surface 703 can fit into the second guide channel 621. Additionally, and/or alternatively, the housing 132 can be attachable to the secondary bracket 710 such that the housing 132 can move relative to the mounting bracket 610 in at least one direction. For example, as shown in FIG. 9, the housing 132 (e.g., the shroud 139) can be attached to the secondary bracket 610 via an attachment mechanism (e.g., screw) placed in the hole 712. In this way, the housing 132 can be allowed to move within the threshold distance 804 defined by the secondary bracket 710. Moreover, the end cover guide surface(s) 702 and 703 can be configured to move within the within the guide channel(s) 620 and 621, within a range similar to that of the threshold distance 804.

Returning to FIG. 8, the lighting fixture 130 can include a control mechanism 630 that is configured to alter and/or stop the movement of the patient bed 110 when the housing 132 has moved a threshold distance. For instance, the control mechanism 630 can be positioned adjacent the secondary bracket 710. The control mechanism 630 can include a switch arm lever 730 and, as shown, at least a portion of the switch arm lever 730 can contact the secondary bracket 710. Upon application of a force 802, both the housing 132 and the secondary bracket 710 can move along the vertical direction 705. When the housing 132 and secondary bracket 710 have moved the threshold distance 804, the control mechanism 630 can be activated. In this way, the control mechanism 630 can alter and/or stop the movement of patient bed 110 before and/or when the housing 132 reaches its movement limitation (e.g., threshold distance 804).

Upon activation, the control mechanism 630 can be configured to send a command signal to the controller 120 to change and/or terminate the movement of the patient bed 110 when the housing 132 has moved a threshold distance. In some implementations, the control mechanism 630 can be connected to the power source 124 (e.g., outlet for connecting electrical power), such that when the control mechanism 630 is activated the power supply for the movement of the patient bed 110 is shut off. When the switch lever arm 730 is in a first position (FIGS. 6 and 7), the switch can be open and the power to the patient bed 110 can be on. When the lever arm 330 is in a second position (FIGS. 8 and 9), the switch can be closed and the power to the patient bed 110 can be off.

In some implementations, when the lighting fixture 130 is stationary, the switch lever arm 730 can rest on the secondary bracket 710 such that the switch level arm 730 is in the first position. The patient bed 110 (and/or equipment associated therewith) can then apply a force 802 to the lighting fixture 130. The force 802 can arise from the patient bed 110 and/or other equipment pressing against the lighting fixture 130 when the patient bed 110 is being adjusted. Upon application of the force 802, the housing 132 can move (e.g., in vertical direction 705) relative to the mounting bracket 610, which can remain stationary. As the housing 132 moves along the vertical direction 705, the secondary bracket 710 moves along the vertical direction 705 towards the flange 711 of the mounting bracket 610. When the secondary bracket 710 moves towards the flange 711, the amount of vertical space (e.g., threshold distance 804) between secondary bracket 710 and the flange 711 decreases until the secondary bracket 710 contacts the flange 711. Further, as the secondary bracket 710 moves towards the flange, the switch lever arm 730 begins to move from the first position (FIGS. 6 and 7) towards the second position (FIGS. 8 and 9). It should be appreciated that the switch lever arm 730 reaches the second position when the secondary bracket 710 reaches its movement limitation (e.g., threshold distance 804).

When in the second position, the control mechanism 630 can be configured to turn off the power to the patient bed 110 (e.g., by opening a switch associated with the power source 124) such that the mechanism configured to adjust patient bed 110 (e.g., controller 120) is unable to further adjust the position/orientation of the patient bed 110. Additionally, and/or alternatively, the control mechanism 630 can send a command signal to the controller 120 to cease further movement of the patient bed 110 (at least in the direction towards the lighting fixture 130). In this way, the control mechanism 630 can prevent further application of force 802 and/or movement of the housing 132, helping to prevent potential damage to lighting fixture 130.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A lighting fixture comprising:

a housing configured to house a light source;

a mounting bracket configured to attach with the housing to secure the housing to a surface, the mounting bracket comprising a guide mechanism and a secondary bracket, the guide mechanism defining a guide channel, the secondary bracket being adjustable in at least one direction, wherein the housing is attachable to the mounting bracket such that at least a portion of the housing is movable relative to the mounting bracket along the guide channel of the guide mechanism when a force is applied to the housing, and wherein the housing is attachable to the secondary bracket such that the housing is movable relative to the mounting bracket in at least the one direction.

2. The lighting fixture of claim 1, wherein the guide mechanism has a G-hook shape.

3. The lighting fixture of claim 1, wherein the guide mechanism comprises a linear surface extending at a non-perpendicular angle from a back plate of the mounting bracket.

4. The lighting fixture of claim 1, wherein the housing comprises an end cap, the end cap having a pin extending from a surface of the end cap.

5. The lighting fixture of claim 4, wherein the guide mechanisms is configured to receive the pin of the end cap.

6. The lighting fixture of claim 5, wherein the pin moves along the guide surface of the guide mechanism when the force is applied to the housing.

7. The lighting fixture of claim 1, wherein the force comprises an upward vertical force.

8. The lighting fixture of claim 1, wherein the lighting fixture comprises a control mechanism configured to alter movement of an object applying force to the lighting fixture.

9. The lighting fixture of claim 1, wherein the lighting fixture is positioned within the vicinity of a patient bed.

10. The lighting fixture of claim 9, wherein the lighting fixture comprises a control mechanism configured to alter the movement of the patient bed when the patient bed applies force to the lighting fixture.

11. The lighting fixture of claim 10, wherein the control mechanism is configured to stop movement of the patient bed when the housing has moved a threshold distance.

12. The lighting fixture of claim 8, wherein the control mechanism comprises a switch lever arm.

13. The lighting fixture of claim 12, wherein the switch lever arm engages a pin extending from an end cap when the housing is attached to the mounting bracket.

14. A lighting fixture, comprising:

a housing configured to house a light source, the housing having an end cap, the end cap having a pin extending from a surface of the end cap;

a mounting bracket having a back plate that is attachable to mounting surface, the mounting bracket comprising a guide mechanism extending from the back plate, the guide mechanism defining a guide channel, the mounting bracket comprising a secondary bracket, the secondary bracket having a movable mechanism attached to the housing, the movable mechanism configured to move a distance range;

wherein the pin is received into the guide channel when the housing is attached to the secondary bracket, wherein the housing is movable relative to the mounting bracket when a force is applied to the housing such that the pin moves along the guide channel defined by the guide mechanism.

15. The lighting fixture of claim 14, wherein the guide mechanism has a G-hook shape.

16. The lighting fixture of claim 14, wherein the guide mechanism comprises a linear surface extending at a non-perpendicular angle from a back plate of the mounting bracket.

17. The lighting fixture of claim 14, wherein the lighting fixture comprises a control mechanism configured to alter movement of an object applying force to the lighting fixture, the control mechanism comprising a switch lever arm, wherein the switch lever arm is disposed adjacent to the pin extending from the surface of the end cap.

* * * * *